US005228512A

United States Patent [19]

Bretl et al.

[11] Patent Number: 5,228,512

[45] Date of Patent: Jul. 20, 1993

[54] ALUMINUM CHARGE AIR COOLER AND METHOD OF MAKING THE SAME

[75] Inventors: Richard A. Bretl, Union Grove; Dan R. DeRosia; Charles E. Goodremote, Racine; Peter C. Kottal, Racine, all of Wis.

[73] Assignee: Modine Manufacturing Company, Racine, Wis.

[21] Appl. No.: 679,519

[22] Filed: Apr. 2, 1991

[51] Int. Cl.[5] ..... F28D 1/053; F28F 9/16

[52] U.S. Cl. ..... 165/153; 165/173; 165/78; 228/183; 29/890.043

[58] Field of Search ..... 165/78, 153, 173; 228/183; 29/890.03, 890.043

[56] References Cited

U.S. PATENT DOCUMENTS

| | | | |
|---|---|---|---|
| 3,245,465 | 4/1966 | Young | 165/173 X |
| 3,310,868 | 3/1967 | La Porte et al. | 228/183 X |
| 3,782,450 | 1/1974 | Swozil | 165/81 |
| 4,234,041 | 11/1980 | Melnyk | 165/173 |
| 4,377,024 | 3/1983 | Saperstein | 29/157.3 C |
| 4,465,129 | 8/1984 | Baldensperger et al. | 165/153 |
| 4,522,330 | 6/1985 | Kerrey et al. | 228/182 |
| 4,651,821 | 3/1987 | Moranne | 165/175 |
| 4,722,387 | 2/1988 | Aurand | 165/153 |
| 4,938,284 | 7/1990 | Howells | 165/149 |

*Primary Examiner*—Allen J. Flanigan

*Attorney, Agent, or Firm*—Wood, Phillips, VanSanten, Hoffman & Ertel

[57] ABSTRACT

Thermal and pressure related fatigue or stress in the header plates (26, 28) of a charge air cooler is avoided in a structure wherein the header plates (26, 28) are formed of a channel having a central web (80) flanked by legs (82, 84) and provided with apertures (86) for receiving the ends of tubes (36). The apertures (86), on the side thereof between the legs (82, 84), are provided with peripheral flanges (88, 90, 92, 94) and on the opposite side are substantially surrounded by concave camming surfaces (96, 98).

11 Claims, 3 Drawing Sheets

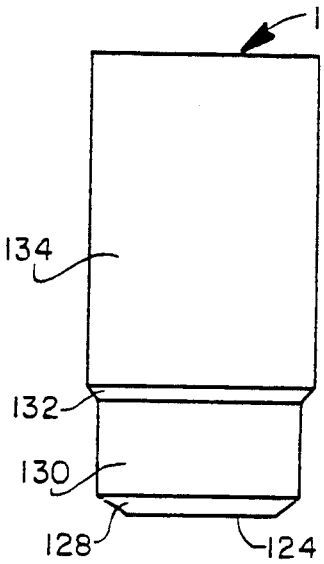
FIG. 11
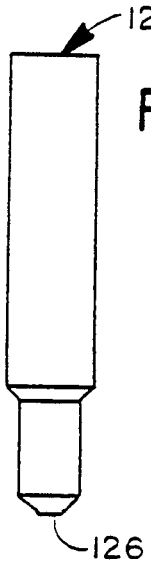
FIG. 12
FIG. 13
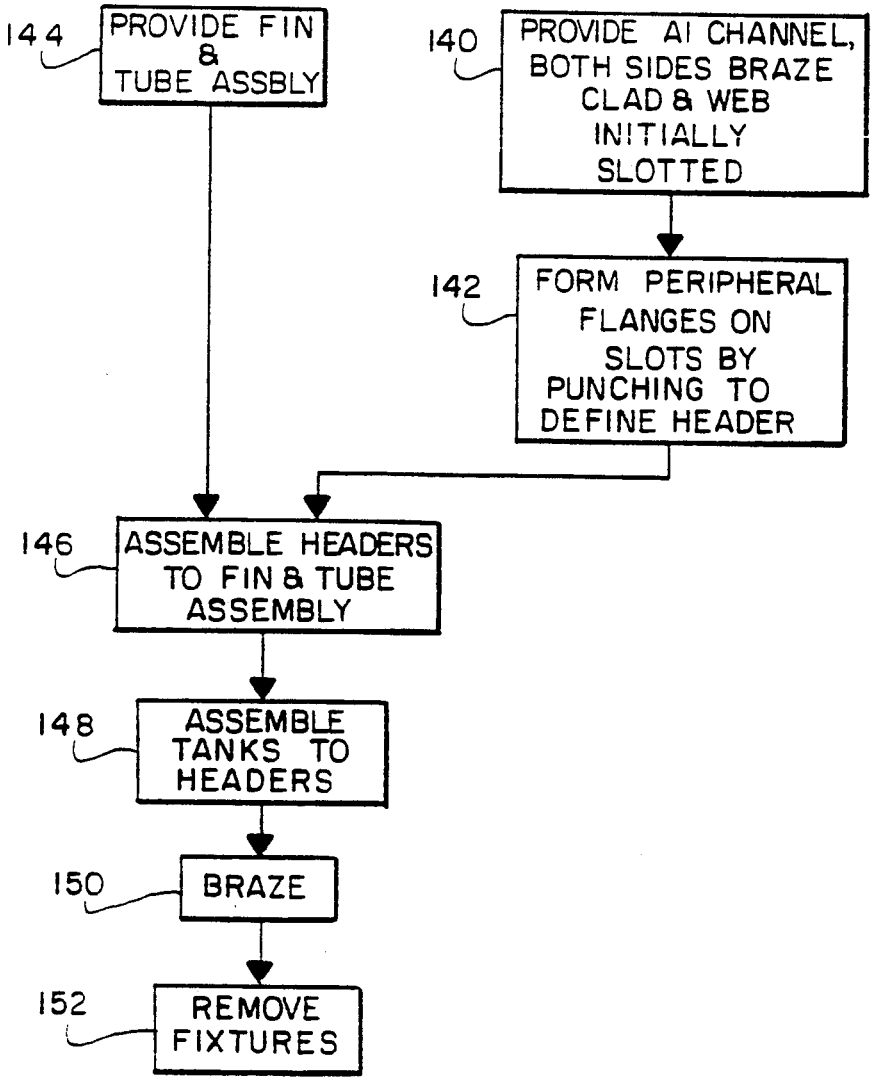

ALUMINUM CHARGE AIR COOLER AND METHOD OF MAKING THE SAME

FIELD OF THE INVENTION

This invention relates to heat exchangers, and more particularly, to aluminum heat exchangers and heat exchangers that are particularly suited for use as so-called charge air coolers in internal combustion engine systems.

BACKGROUND OF THE INVENTION

For any of a variety of reasons, internal combustion engine systems are experiencing an increase in the use of turbochargers. As is well-known, a turbocharger includes a turbine wheel that is driven by the exhaust gases from the engine and which in turn drives a rotary compressor. The rotary compressor compresses combustion air prior to its admission to the combustion chambers of the internal combustion engine. Systems of this sort recover part of the waste energy that results when incompletely spent exhaust gases are permitted to expand without performing work and also provide for higher compression ratios than are attained by the geometry of the internal combustion engine itself.

It has long been observed that when the incoming combustion air is compressed by the turbocharger, it is simultaneously heated which in turn means that its density is decreased. Consequently, at any given pressure, a unit volume of hot air from a turbocharger contains a lesser quantity of oxygen available for combustion than would an identical volume of cold air at the same pressure. This factor in turn places a limitation on the amount of fuel that may be burned in any given operating cycle of an internal combustion engine, which in turn limits the output thereof. Consequently, particularly in vehicular applications, a so-called charge air cooler has been introduced between compressor stages or between the compressor side of the turbocharger and the intake manifold (or equivalent) for the internal combustion engine. The hot, combustion air from the turbocharger is passed through the charge air cooler to the engine. At the same time, ambient air is being passed through the charge air cooler in a flow path isolated from the combustion air, but in heat exchange relation therewith. Consequently, cooling of the combustion air is obtained to increase the density of the combustion air to ultimately provide a greater quantity of oxygen per charge of air to the engine to support combustion.

It can readily be appreciated that even though the elevated pressure of the combustion air results in a relatively small pressure differential with ambient, charge air coolers operate in relatively stressful environments. Typically, because they are employed in vehicular installations, they are subject to a great deal of vibration and shock as the vehicle travels over the underlying terrain.

Furthermore, they are subject to thermal cycling, that is, alternating heating and cooling, not only as the vehicle engine is turned on or off, but during operation of the same at varying speeds. Changes of combustion air velocity with varying engine speed within the tanks of a typical charge air cooler may result in temperature gradients as high as 25° F. from one tube to the next which, over a period of time, can result in substantial stress at tube to header joints.

Finally, even though as mentioned previously, typical charge air coolers do not operate at pressures significantly above ambient, because charge air coolers are required to pass a large volume of combustion air to the engine with minimal resistance, large flow paths are employed, which in turn are defined by surfaces of a relatively large area. And where even extremely low pressure differentials are applied across large surface areas, those skilled in the art will appreciate that substantial forces exist, thus putting further stress on charge air cooler components.

The present invention is directed to overcoming one or more of the above problems.

SUMMARY OF THE INVENTION

It is the principal object of the invention to provide a new and improved heat exchanger. More specifically, it is an object of the invention to provide a new and improved heat exchanger that is specifically intended to be utilized as a charge air cooler along with a method of manufacturing the same.

According to one facet of the invention, the foregoing object is achieved in a method of making a heat exchanger which includes the steps of: (a) providing a fin and tube bundle of spaced, parallel tubes and interposed fins with braze clad material at the interface of the tubes and fins; (b) providing a metallic channel with braze clad material on both sides thereof; (c) forming in the web of the channel a series of apertures shaped as the cross section of the tubes and spaced according to the nominal spacing of the tubes and with peripheral flanges extending from the web in the direction of the legs of the channel to thereby define a header plate; (d) assembling the header and the fin and tube bundle together with the tubes entering respective apertures and located within the associated flanges; (e) assembling a metallic tank to the header opposite of the bundle; and (f) subjecting the assembly resulting from step (e) to brazing conditions sufficient to braze the fins to the tubes, the tubes to the flanges and the header to the tank.

In a preferred embodiment, the header channel, the tubes and the tank are formed primarily of aluminum.

In a highly preferred embodiment, step (c) is performed by first forming spaced holes in the web of a side less than the cross section of the tubes and then driving a punch having a cross section like that of the tubes through the holes to create the apertures and the associated flanges.

The invention further contemplates that the tubes be flattened tubes and that the apertures be elongated and extend between the legs of the channel. In this embodiment, the flanges, at the ends of the apertures, are in substantial abutment with the legs. This allows a maximum depth of the heat exchanger core for any given tank size.

The invention also contemplates that the step of driving the punch include forming a concave cam surface at least partially about each aperture on the side thereof opposite the flanges to provide a pilot surface for camming the tubes into their respective apertures during the performance of step (d).

According to another facet of the invention, there is provided a method of making a heat exchanger which includes the steps of (a) providing a fin and tube bundle of spaced tubes and interposed fins; (b) providing a channel having a web and spaced legs; (c) forming a header plate by forming in the web of the channel a series of apertures shaped as the cross section of the tubes and spaced according to the nominal spacing of the tubes and with peripheral flanges extending from the web in the direction of the legs of the channel and further forming a concave cam surface at least partially around each aperture on the side thereof opposite the flange to provide a pilot surface for camming a tube into the associated aperture; (d) abutting the header plate resulting from step (c) to the bundle and relatively moving the two toward each other so that tubes enter their respective apertures with or without piloting by initial contact with the concave cam surfaces; (e) fitting a tank between the legs of the channel; and (f) bonding the tubes and the tank to the channel.

In a preferred embodiment of the invention immediately preceding step (f) is performed by brazing.

The invention also contemplates the provision of a heat exchanger which includes first and second spaced, elongated, opposed tanks each having a heat exchange fluid port and a header plate receiving opening. A pair of header plates are provided, one for each tank and each is defined by an elongated channel having flat, central web flanked by space, generally parallel legs. The legs of each header plate flank corresponding sides of the header plate receiving opening of the associated tank and are sealingly bonded thereto. The web of each header plate includes a plurality of spaced, elongated apertures extending substantially from leg to leg. Each aperture, on the same side of the web as the legs, has a peripheral flange with that part of the flange at the ends of the aperture being in substantial contact with the associated leg. Each aperture further includes, on the side of the web opposite the flange, a concave pilot surface at least partially surrounding the aperture for piloting a tube into the associated aperture. A plurality of spaced, parallel, flattened tubes extended between the tanks and have their ends in aligned ones of the apertures in opposite ones of the pair of header plates. Fins extended between and abut the tubes.

In a highly preferred embodiment, the heat exchanger is a charge air cooler for use with an internal combustion engine. Each of the tanks tapers away from the associated heat exchanger fluid port to a progressively smaller cross section and serpentine fins are interposed between and bonded to adjacent ones of the tubes.

In a highly preferred embodiment, the header plate is aluminum and braze clad on both sides thereof. The interior of the flange about each aperture is formed of one of the sides of the header plate and thus carries braze clad. The tubes are formed of aluminum and brazed to the headers by the braze clad material from the one side located on the interior of the flanges. The facing sides of the legs also include braze clad from the other side of the header tank and the tanks are aluminum and brazed to the header plates by the braze clad on the other sides of the header plates.

Other objects and advantages will become apparent from the following specification taken in connection with the accompanying drawings.

DESCRIPTION OF DRAWINGS

FIG. 11 is an elevation of a punch that is used with the die of FIG. 10;

FIG. 12 is an elevation of the punch taken at 90° to FIG. 11; and

FIG. 13 is a block diagram illustrating steps in a method of manufacturing a heat exchanger according to the invention.

DESCRIPTION OF THE PREFERRED EMBODIMENT AND OF PRIOR ART HEADER PLATES

Figure 1:
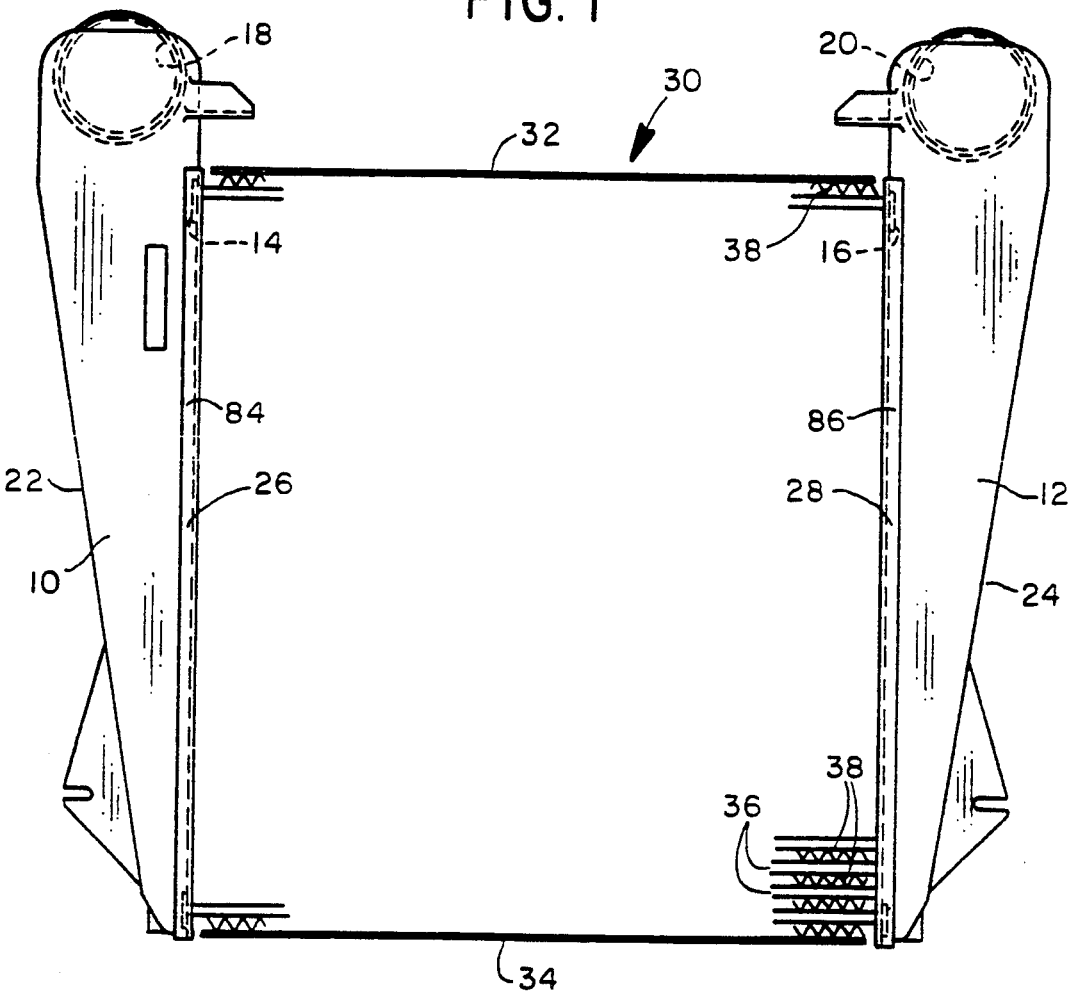
FIG. 1 is a side elevation of a heat exchanger, specifically a charge air cooler, made according to the invention and which is also virtually identical in appearance to a prior art charge air cooler.

An exemplary embodiment of a heat exchanger made according to the invention is illustrated in FIG. 1 in the form of a charge air cooler. However, it is to be understood that the advantages of the invention may be advantageously employed in heat exchangers intended for use other than as charge air coolers and that no restriction to charge air coolers is intended except to the extent set forth in the claims hereof. At the outset, it should also be observed that the charge air cooler shown in FIG. 1 is conventional except insofar as the header plates of the same are concerned. With that background, FIG. 1 will now be described.

The charge air cooler includes opposed tanks 10 and 12 which preferably are formed of aluminum. The tanks 10 and 12 have respective rectangular openings 14 and 16 which extend substantially, but not entirely, the length of the respective tank 10 or 12.

At their upper ends, the tanks 10 and 12 include heat exchange fluid ports 18 and 20 respectively which extend rearwardly as viewed in FIG. 1. One of the ports 18, 20 may be connected to the outlet of a turbocharger forming part of an internal combustion engine system while the other of the ports 18, 20 is ultimately connected to the intake side of an internal combustion engine, both in manners well-known in the art.

To minimize weight and yet provide adequate flow area for good flow distribution, each of the tanks 10, 12 is tapered as at 22, 24 as one progresses away from the associated port 18, 20. Thus, the cross section of the interior of each of the tanks 10 and 12 progressively is reduced as the distance from the port 18, 20 increases.

The openings 14, 16 in the tanks 10 and 12 are completely covered by channel shaped header plate 26, 28 which may be identical to one another. Consequently, in the ensuing description, only one will be described.

Extending between the header plates 26 and 28 is a fin and tube bundle, generally designated 30. The bundle 30 is made up of three components, namely, side plates or pieces 32 and 34 at the top and bottom of the bundle 30, parallel, elongated, flattened tubes 36 extending between the headers 26, 28 and entering the associated tanks 10, 12 to be in fluid communication with the interior thereof, and serpentine fins 38 located between adjacent tubes 36 or one of the tubes 36 and an adjacent side plate 32, 34. It will be observed from FIG. 1 that the side plates 32, 34, while elongated, have a length less than the distance between the headers 26, 28.

At this point, a pause in the description of the preferred embodiment of the invention is considered in order for the purpose of discussing prior art header constructions. As mentioned previously, the headers 26, 28 are formed of channels and to that extent are no different than the prior art such as the prior art header, generally designated 40, shown in FIG. 2. The header 40 includes a flat, central web 42 and two, generally parallel legs 44, 46 flanking the same. Within the web are a series of elongated apertures 48 which are spaced apart a distance corresponding to the nominal spacing between the tubes 36 and which are elongated in the direction extending between the legs 44 and 46. The length of the elongation of the apertures 48 is equal to the length of elongation of the cross section of each of the tubes 36. It will be observed that in the prior art header 40, the ends 50 of the apertures 48 stop short of extending all the way to the inner surfaces of the legs 44 and 46 which are represented by dotted lines 52 and 54 respectively. In the usual case, the tubes 36 would be brazed within the apertures 50.

In use as part of a charge air cooler, the header 40 would be subjected, on its surface between the legs 44 and 46, to varying pressures and it will be immediately appreciated that the structure is such that the areas of the web 42 surrounding each aperture 48 will flex much like a diaphragm in response to pressure changes within an associated tank 10 or 12. As a consequence, the tube to header joints were subject to such flexure and would be prone to fail as a result of stress and fatigue.

Figure 2:
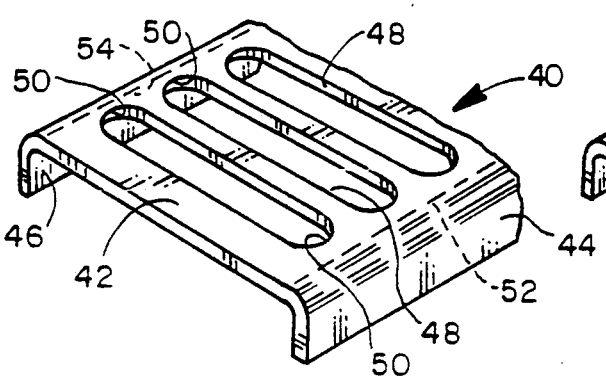
FIG. 2 (PRIOR ART)
FIG. 2 is a fragmentary, perspective view of a header plate made according to the prior art.
Figure 3:
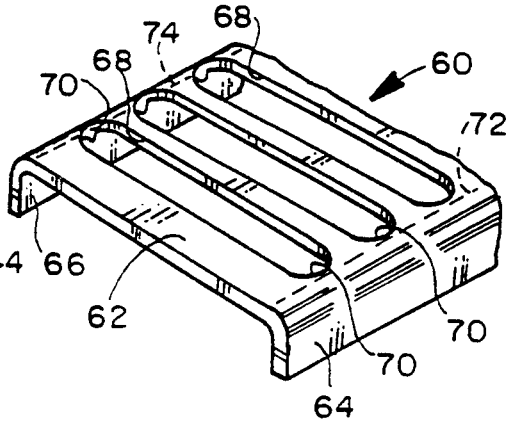
FIG. 3 (PRIOR ART)
FIG. 3 is a view similar to FIG. 2, but illustrating a header plate of more recent vintage, though still prior art.
Figure 4:
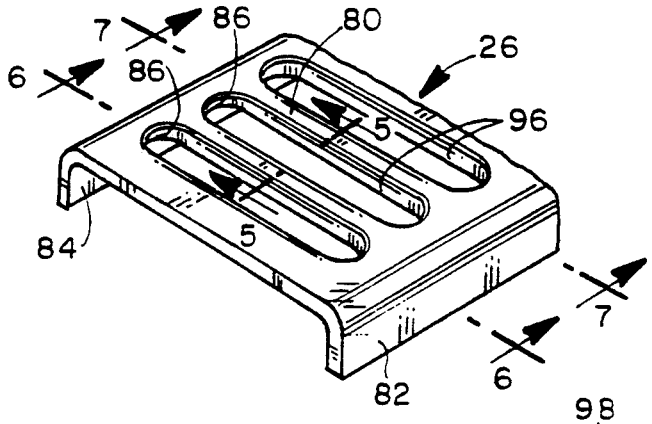
FIG. 4 is a view similar to FIGS. 2 and 3, but of a header plate made according to the invention.

Recognizing this problem, the prior art turned to a header construction as shown in FIG. 3 and generally designated 60. In this case, there is again a flat central web 62 flanked by parallel legs 64 and 66. Apertures 68 that are elongated and shaped to receive the tubes 36 extend between the legs 64 and 66. However, in this case, the ends 70 of the apertures extend substantially to the inner surfaces of each of the legs 64, 66 as indicated by dotted lines 72, 74 respectively. That is to say, the area of the web 42 existing between the end 50 of each of the apertures 48 and the inner surface 52 or 54 of the adjacent leg 44 or 46 is eliminated in the prior art structure of FIG. 3 which in turn greatly reduces or eliminates all together the diaphragm flexing effect found in the prior art structure of FIG. 2.

However, the prior art structure of FIG. 3 continues to share other difficulties found in the embodiment of FIG. 2. For example, rigidity across the web 62 is less than desired. For another, in order to braze aluminum tubes into the apertures 68 or the apertures 48, braze metal would either have to flow from the surface of the web 62 or 42 "around the corner" into the apertures 68 or 48 or else the tubes themselves would have to be braze clad. In the case of the former, a higher percentage of imperfectly formed or weak joints is encountered while in the case of the latter, providing all of the tubes with braze clad along their entire lengths essentially only to use the braze clad at the ends thereof is undesirably expensive.

Still a further problem in terms of difficulty of assembly was encountered. In the usual case, the fin and tube bundle 30 are formed and placed in a fixture. Header plates are located at opposite ends thereof and nominally aligned with the ends of the tubes 36. Lateral pressure is exerted on one or both of the side plates 32, 34 toward the other side plate while providing relative movement of the header plate 26, 28 toward the associated ends of the tubes 36. The pressure is intended to be sufficient to compress the bundle 30 to cause alignment of the tube ends 36 so that they could readily enter the apertures 48 or 68 and the webs 42 or 62, respectively. This process, however, is somewhat tedious and if attempts are made to speed it up by enlarging the apertures 48, 68 so they will more readily receive the ends of the tubes 36, there results an increase in the tendency to improperly form a tube to header joint in the subsequent brazing process.

With the foregoing in mind, the improved header 26, 28 of the invention will be described and inasmuch, as noted previously, as the two are identical, only the header 26 will be described. Referring to FIGS. 4–8, the header 26 is seen to be formed of a central, flat web 80 flanked by parallel, elongated legs 82, 84. Typically, the header 26 will be made of aluminum and in addition, will be provided with braze clad material clad on both sides thereof.

Figure 5:
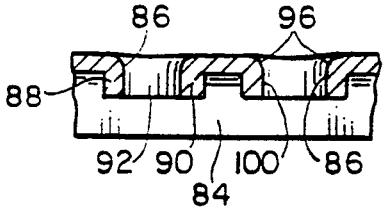
FIG. 5 is a sectional view taken approximately along the line 5—5 in FIG. 4.
Figure 6:
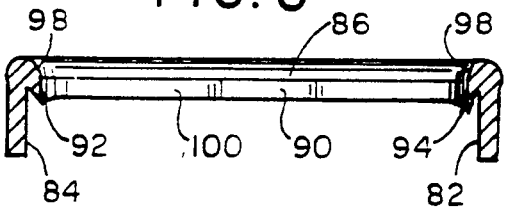
FIG. 6 is a sectional view taken approximately along the line 6—6 in FIG. 4.
Figure 7:
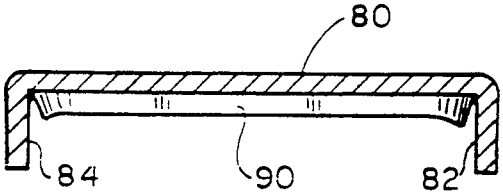
FIG. 7 is a sectional view taken approximately along the line 7—7 in FIG. 4.
Figure 8:
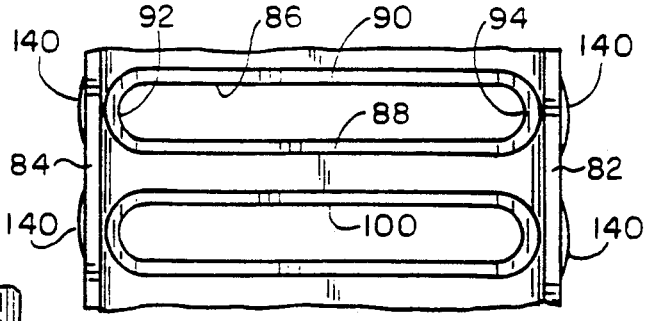
FIG. 8 is a fragmentary, bottom view of the header.

Elongated apertures 86 are located in the web 80 and extend between the legs 82, 84. As seen in FIGS. 5 and 6, the periphery of each of the apertures 86 is completely surrounded by a flange 88, 90, 92, 94 located between the legs 82, 84. As can be ascertained from FIG. 5, the flange 88, 90, 92, 94 includes two elongated flange sides 88 and 90 and as can be seen in FIG. 6, the flange sides 88 and 90 terminate in rounded end flanges 92 and 94 which as seen in FIG. 8 define a continuous single flange 88, 90, 92, 94 with the end flanges 92, 94 of such flange being in substantial abutment with the adjacent leg 82, 84. This provides apertures 86 having a length that minimizes or eliminates the diaphragm effect just as the apertures 68. Furthermore, by elongating the apertures 86 to the point where the flange sections 92, 94 abut the corresponding leg 82, 84, for any given tank and/or header size, core depth is maximized. In most cases this will increase efficiency without increasing core facial area. In addition the flange sections 88 and 90, being substantially at right angles to the plane of the web 80, serve to rigidify the same from one side to the other to provide enhanced across the web rigidity over the prior art headers 40 and 60 shown in FIGS. 2 and 3 respectively.

In addition to the provision of the flange 88, 90, 92, 94 surrounding each of the apertures 86, on the side of the web 80 opposite the legs 82, 86, each of the apertures 86 is at least partially surrounded by a concave cam surface having elongated parts 96 and end parts 98 along the length and at the ends of each of the apertures 86 respectively. It will be appreciated that the cam surfaces 96, 98 are on the tube receiving side of the header 86 and thus when the header and tubes are moved relatively toward each other, misaligned tubes will strike the cam surface and be cammed into alignment and into the apertures 86 so that they may ultimately engage the inner surface 100 of the flange 88, 90, 92, 94. This inner surface 100 is configured so as to fairly closely mimic the exterior shape of the end of the tube 36 sufficiently that an excellent braze connection can be achieved.

Figure 9:
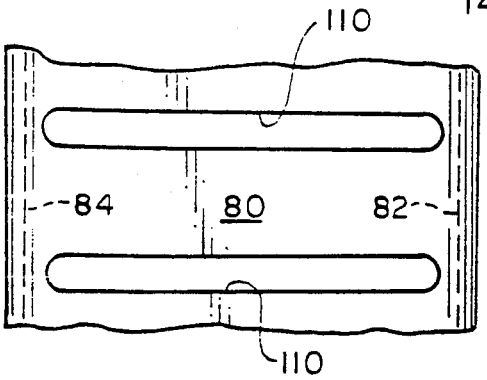
FIG. 9 is a fragmentary, plan view of the header at an intermediate state in its construction.

The manner in which the header 26 is formed is best understood from a consideration of FIGS. 9–12. The channel may be formed by stamping of any sheet of aluminum that is braze clad on both sides and elongated holes 110 are disposed in the web 80 on the centers of the apertures 86 that are ultimately to be formed therein. As can be seen in FIG. 9, the holes 110 are narrower than the apertures 86 and have a lesser, across the web length than the apertures 86.

Figure 10:
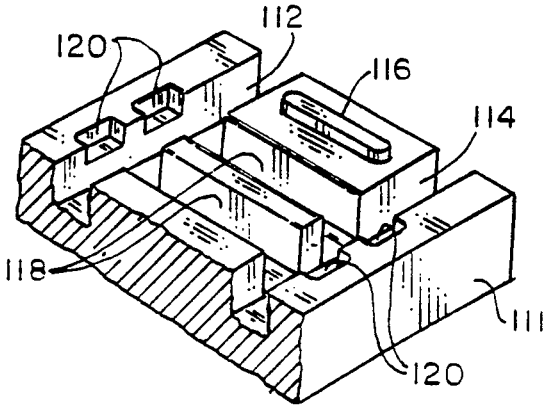
FIG. 10 is a perspective view of a die or fixture that may be utilized in forming the header.

This channel may then be placed in a fixture or die 111 such as illustrated in FIG. 10. The fixture shown in FIG. 10 includes parallel slots 112, 114 for receipt of the legs 82, 84 respectively. If desired, the upper surface of the fixture 111 may include a pilot projection 116 that may be received in an endmost one of the holes 110 to properly locate the channel in the fixture 111.

Cross slots 118 are located in the upper surface of the fixture 111 on centers corresponding to the centers of the apertures 86 ultimately to be formed. At the end of each of the slots 118, on the opposite side of the parallel slot 112 or 114, there is formed a relief 120. The reliefs 120 have a width approximately equal to the width of each of the slots 118, but their depth is only approximately one-half the depth of each of the parallel slots 112, 114.

Also used in forming the apertures 86 is a punch such as the punch generally designated 122 in FIGS. 11 and 12. The punch includes an end 124 including a central flat section 126 and which is flanked on all four sides by a bevel 128. The bevel 128 merges into a punch section 130 which has a configuration or shape that is identical to the interior surface 100 of the flange 88, 90, 92, 94. The section 130 in turn merges into a slightly concave bevel or internal round 132 which conforms in shape to the cam surface 96, 98. The round 132 then merges into the remainder of the punch 134.

Keeping in mind that the holes 110 are smaller than the apertures 86, when the channel is arranged in the fixture 111 and the punch applied to the holes 110, it will be appreciated that that material surrounding each of the holes 110, but within the envelope of the punching section 130 will deform to form the flange 88, 90, 92, 94. Driving the punch 122 fully into the slots 118 will also result in the round 132 coming in contact with the upper surface of the web 80 to result in the formation of the concave cam surface 96, 98 surrounding each of the apertures 86. Typically, punches 122 Will be gauged so that several or all of the flanges 88, 90, 92, 94 in a single header plate will be formed simultaneously.

In practice, it has been found that the formation of the flange 88, 90, 92, 94 in this fashion results in the exertion of substantial outward force in the area of the portions 92 and 94 of the flange such that, as seen in FIG. 8, the outer surfaces of the legs 82 and 84 are slightly bulged as at 140. However, these bulges are directed into the reliefs 120 in the fixture 111 and as a consequence, any tendency of the header to wedge within the fixture 111 is avoided.

FIG. 13 illustrates, in block form, a method of manufacturing a heat exchanger such as a charge air cooler, according to the invention. Blocks 140 and 142 implement steps in the formation of the headers as described immediately preceding. That is, they illustrate the steps of providing an aluminum channel with both sides braze clad and with a web that is initially slotted as well as the formation of peripheral flanges on the slots by punching to define the header plate. Another initial step in the invention is illustrated at a block 144 and is the step of providing the fin and tube bundle 30 including the side pieces 32, 34, the tubes 36 and serpentine fins 38 between the tubes 36 or between a tube 36 and one of the side pieces 32 and 34. This is done in a conventional fashion by alternately stacking the tubes and the fins and then utilizing any suitable fixture to maintain the same in assembled relation.

In the usual case, the tubes 36 will be aluminum and the fins 38 aluminum as well. Usually, but not always, the tubes 36 will be extruded. Typically, the fins will be formed of aluminum brazing sheet to provide the braze metal required to bond to the tubes 36 and the side pieces 32 and 34.

Also, in the usual case, the tubes 36 will previously have been provided with internal turbulators as, for example, lanced and offset turbulators. When such turbulators are provided, the tubes are frequently "spanked" to abut the turbulators preliminary to a brazing operation.

At the block designated 146, the headers 26 and 28 are assembled to the fin and tube bundle 30. This is accomplished by effecting relative movement between the fin and tube bundle 30 and one of the headers 26 such that the two move toward each other. Those ones of the ends of the tubes 36 that are perfectly aligned with a corresponding aperture 86 will, of course, enter such an aperture without difficulty. Those that are misaligned, will encounter the cam surfaces 96, 98 and be piloted into the corresponding aperture 86. The tube ends are caused to enter the apertures 86 at least to the depth of the flange 88, 90, 92, 94. A fixture may be used to maintain the headers 26, 28 assembled to the fin and tube bundles 30 as is well-known.

The next step is to assemble the tanks 10 and 12 and the headers 26, 28, respectively; and such a step is illustrated in the block 148. As can be seen in FIG. 1, the tanks 10, 12 are nestled between the legs 84, 86 of the respective header 26, 28 and orientated such that the entire header receiving opening 14, 16 is covered. Again, a suitable fixture may be utilized to maintain the tanks 10 assembled to the headers.

Thereafter follows a brazing operation such as illustrated at the block 150. The brazing operation involves exposing the tank-header-fin and tube bundle to brazing conditions for a sufficient period of time as to cause the fins 38 to braze to the tubes 36, the tube ends to braze to the flanges 88, 90, 92, 94, the legs 82, 84 to braze to the tanks 10, 12 and for the side of the web 80 between the legs 82, 84, at the ends thereof, to braze to the tanks 10, 12 adjacent the ends of the openings 14 16.

Once the brazing operation has been completed, the fixtures may be removed as indicated by a block 152.

As alluded to earlier, substantial advantages flow from the invention. For one, the provision of the cam surfaces 96, 98 surrounding each of the apertures 86 eases assembly in terms of providing a ready means for the ends of the tubes 36 to enter the apertures 86. The provision of the flange 88, 90, 92, 94 around each of the apertures 86 provides two advantages. For one, it rigidifies the web 80 in the across the web direction. For another, because it is formed in the manner previously described out of aluminum sheet which is braze clad on both sides, it will be readily appreciated that the inner surface 100 of the flange 88, 90, 92, 94 remains provided with the braze clad material to provide an excellent bond. That is to say, the brazed tube to header joint does not require the flow of braze clad material from some other location on the header nor does it require the use of braze cladding on the tubes 36. And where the flange sections 92, 94 abut the legs of the channel, core depth is maximized for improved efficiency. Alternatively, for any given core, header depth may be reduced to thereby minimize the volume of the heat exchanger.

At the same time, the braze clad on the opposite surface of the sheet of which the header 26 is formed provides braze clad material on the inner surfaces of the legs 82 and 84 to provide a braze and sealed joint along those legs with the respective one of the tanks 10, 12. The braze clad material on the same side of the original sheet, but on the underside of the web 80 also acts to provide a brazed and sealed joint at each end of the header 26 or 28 to the tank 10, 12.

Thus, the invention provides not only an improved method of fabricating a heat exchanger such as might be used as a charge air cooler, but an improved heat exchanger which is ideally suited for use in the hostile environment encountered by a charge air cooler employed on a vehicle.

We claim:

1. A method of making a heat exchanger comprising the steps of:

a) providing a fin and tube bundle of spaced parallel tubes and interposed fins with braze material at the interface of the tubes and fins;

b) providing a metallic channel with braze clad material on both sides thereof;

c) forming in the web of the channel a series of apertures shaped in the cross section of the tubes and spaced according to the nominal spacing of the tubes and with peripheral flanges extending from the web in the direction of the legs of the channel to thereby define a header plate by first forming elongated spaced holes in the web of a size less than the cross section of said tubes and then driving a punch having a cross section like that of the tubes through the holes to create said apertures and the associated flanges;

d) assembling the header and the bundle together with the tubes entering respective apertures and located within the associated flanges;

e) assembling a metallic tank to the header opposite to the bundle; and f) subjecting the assembly resulting from step e) to brazing conditions sufficient to braze the fins to the tubes, the tubes to the flanges and the header to the tank.

2. The method of claim 1 wherein said header, said tubes and said tank are formed primarily of aluminum.

3. The method of claim 1 wherein said tubes are flattened tubes and said apertures are elongated and extend between said legs, and said flanges at the ends of said apertures, are in substantial contact with said legs.

4. The method of claim 3 wherein the step of driving the punch includes forming a concave cam surface at least partially about each aperture on the side thereof opposite said flanges to provide a pilot surface for camming the tubes into said respective apertures during the performance of step d).

5. A method of making a heat exchanger comprising the steps of:

a) providing a fin and tube bundle of spaced parallel tubes and interposed fins;

b) providing a channel having a web and spaced legs;

c) forming a header plate by forming in the web of the channel a series of apertures shaped in the cross section of the tubes and spaced according to the nominal spacing of the tubes and with peripheral flanges extending from the web in the direction of the legs of the channel and further forming a concave cam surface at least partially around each aperture on the side thereof opposite said flange to provide a pilot surface for camming a tube into the associated aperture;

d) abutting the header plate resulting from step c) to the bundle and relatively moving the two toward each other so that the tubes enter their respective apertures with or without piloting by initial contact with said concave cam surfaces;

e) fitting a tank between the legs of the channel; and f) bonding the tubes and the tank to the channel.

6. The method of claim 5 wherein step f) is performed by brazing.

7. An charge air cooler for an internal combustion engine comprising:

first and second spaced, elongated opposed tanks each having a heat exchange fluid port and a header plate receiving opening, each tank further tapering away from the associated port to a progressively smaller cross section;

a pair of header plates, one for each tank and each defined by an elongated channel having a flat central web flanked by spaced, generally parallel legs, the legs of each header plate flanking corresponding sides of the header plate receiving opening of the associated tank and being sealingly bonded thereto, the web of each header plate including a plurality of spaced, elongated apertures extending substantially from leg to leg, each aperture, on the same side of the web as the legs, having a peripheral flange with that part of the flange at the ends of the aperture being in substantial contact with the associated leg, each aperture, on the side of the web opposite the flange being at least partially surrounded by a concave pilot surface for piloting a tube into the associated aperture;

a plurality of spaced parallel flattened tubes extending between said tanks and having their ends in aligned ones of said apertures in opposite ones of said pair of header plates; and serpentine fins interposed between and bonded to adjacent ones of said tubes.

8. The charge air cooler of claim 7 wherein said header plate is aluminum and braze clad on both sides thereof and the interior of the flange about each aperture is formed of one of the sides of said header plate to have braze clad thereon; said tubes being formed of aluminum and brazed to said headers by the braze clad material from said one side located on the interior of said flanges; and the facing sides of said legs include the braze clad from the other side of said header plate, said tanks being aluminum and brazed to said header plates by the braze clad on said other sides of said header plates.

9. A heat exchanger comprising:

first and second spaced, elongated opposed tanks each having a heat exchange fluid port and a header plate receiving opening;

a pair of header plates, one for each tank and each defined by an elongated channel having a flat, central web flanked by spaced, generally parallel legs, the legs of each header plate flanking corresponding sides of the header plate receiving opening of the associated tank and being sealingly bonded thereto, the web of each header plate including a plurality of spaced, elongated apertures extending substantially from leg to leg, each aperture, on the same side of the web as the legs, having a peripheral flange with that part of the flange at the ends of the aperture being in substantial contact with the associated legs, each aperture, on the side of the web opposite the flange being at least partially surrounded by a concave pilot surface for piloting a tube into the associated aperture;

a plurality of spaced parallel flattened tubes extending between said tanks and having their ends in aligned ones of said apertures in opposite ones of said pair of header plates; and fins extending between and abutting said tubes.

10. The heat exchanger of claim 9 wherein said headers, tanks, tubes and fins are metal and are brazed together.

11. The heat exchanger of claim 10 wherein said metal is aluminum and said header plates are braze clad on both sides thereof.

* * * * *